US007971429B2

(12) United States Patent
Forthmann et al.

(10) Patent No.: US 7,971,429 B2
(45) Date of Patent: Jul. 5, 2011

(54) PROCEDURE FOR THE REGENERATION OF A PARTICLE FILTER AND FOR THE DESULPHURIZATION OF AN $NO_x$ STORAGE CATALYTIC CONVERTER

(75) Inventors: Stefan Forthmann, Schoental-Ot Berlichingen (DE); Frank Schweizer, Schwaikheim (DE); Stefan Scherer, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 964 days.

(21) Appl. No.: 11/827,627

(22) Filed: Jul. 12, 2007

(65) Prior Publication Data

US 2008/0022655 A1 Jan. 31, 2008

(30) Foreign Application Priority Data

Jul. 27, 2006 (DE) ..... 10 2006 034 805

(51) Int. Cl.
*F01N 3/00* (2006.01)
*F01N 3/10* (2006.01)
*F01N 3/02* (2006.01)

(52) U.S. Cl. ..... 60/295; 60/274; 60/285; 60/301; 60/311

(58) Field of Classification Search ..... 60/273, 60/285, 295, 297, 301, 274, 311; 95/273, 95/278, 283

See application file for complete search history.

(56) References Cited

U.S. PATENT DOCUMENTS

2005/0022506 A1* 2/2005 Nishizawa et al. ..... 60/276
2006/0191257 A1* 8/2006 Goralski et al. ..... 60/295
2007/0271902 A1* 11/2007 Noirot et al. ..... 60/273

FOREIGN PATENT DOCUMENTS

DE 199 45 336 3/2001
WO WO 2005052331 A1 * 6/2005

* cited by examiner

*Primary Examiner* — Thomas E Denion
*Assistant Examiner* — Audrey Klasterka
(74) *Attorney, Agent, or Firm* — Merchant & Gould P.C.

(57) ABSTRACT

The disclosure concerns a procedure for the regeneration of a particle filter and the desulfurization of a $NO_x$ storage catalytic converter in an exhaust gas aftertreatment system of an internal combustion engine. The disclosed procedure allows for the necessary heating energy and fuel consumption required to completely or partially regenerating the particle filter to be significantly reduced. Furthermore, an increase in efficiency of the $NO_x$ storage catalytic converter results, because the process reduces the average sulfur absorption on account of a greater frequency of desulfurization phases. In so doing, the $NO_x$ emissions after the $NO_x$ storage catalytic converter can further be reduced.

12 Claims, 2 Drawing Sheets

PROCEDURE FOR THE REGENERATION OF A PARTICLE FILTER AND FOR THE DESULPHURIZATION OF AN $NO_x$ STORAGE CATALYTIC CONVERTER

The invention concerns a procedure for the regeneration of a particle filter and for the desulfurization of a $NO_x$ storage catalytic converter in an exhaust gas aftertreatment system of an internal combustion engine, whereby for the regeneration of the particle filter in contrast to a normal operation, the temperature of the particle filter in at least one mode of operation "DPF-heating" is elevated and whereby for the desulfurization of the $NO_x$ storage catalytic converter in at least one mode of operation "$NO_x$ storage cat heating" ($\lambda \geqq 1$), the $NO_x$ storage catalytic converter is heated up, and a subsequent mode of operation "$NO_x$ storage cat desulfurize" a Lambda value is set in the exhaust gas of $\lambda<1$.

In the case of diesel motors, reinforced combined exhaust gas aftertreatment systems with a particle filter (DPF) and $NO_x$ storage catalytic converters (NSC) are planned, respectively already deployed, due to the demands with regard to lower emission threshold values.

Particle filters have, however, a limited storage capability and must be regenerated within certain intervals for the restoration of the purification effect. This occurs typically every 250 to 1000 km. In the case of sooty particle filters, the regeneration occurs by means of an elevation of the exhaust gas temperature to typically 550° C. to 650° C. This can result from steps taken in the mixture preparation of the motor or by means of steps taken in the exhaust system. In so doing, an exothermic reaction is set into action, which causes a burnout of the sooty particles, and within a short time (for example 20 minutes) the particle filter is regenerated.

In the case of systems with a $NO_x$ storage catalytic converter (NSC), a differing amount of sulfur will be lodged in the $NO_x$ storage catalytic converter depending upon the sulfur content of the fuel and motor oil used. This sulfur reduces the number of $NO_x$ storage locations in the catalytic converter and thereby diminishes the efficiency of the $NO_x$ storage catalytic converter (NSC). Also for this reason a regular desulfurization of the $NO_x$ storage catalytic converter must in this instance be implemented. Typically this occurs every 2000 to 5000 km. In so doing, the exhaust gas system and with it the NSC are likewise heated up to a high temperature level (typically 600 to 750° C.). Additionally the sulfur is preferably discharged as sulfur dioxide ($SO_2$) by means of phases with a rich exhaust gas mixture ($\lambda \leqq 1$) i.e. with a surplus of CO/HC and $H_2$ with respect to $O_2$.

Both procedures are energy intensive and require in contrast to the normal operation of the engine an additional amount of fuel.

From the German patent DE 19945336 A1 a procedure is known for the open-loop control of a regeneration of a particle filter and a desulfurization of a $NO_x$ storage catalytic converter, whereby the particle filter and the $NO_x$ storage catalytic converter are part of an emission control system of a diesel internal combustion engine. In order to desulfurize the $NO_x$ storage catalytic converter, a minimum temperature as well as a work mode of the diesel internal combustion engine to generate an exhaust gas of $\lambda \leqq 1$ must be present. For the regeneration of the particle filter a regeneration temperature must be exceeded. This application characterizes itself, in that on the one hand a desulfurization necessity of the $NO_x$ storage catalytic converter exists when a first threshold value $S1_{kat}$ for a degree of sulfation is exceeded, and on the other hand a regeneration necessity of the particle filter exists when a first threshold value $S1_{par}$ for a charge value exists. Additionally the desulfurization and the regeneration are then first introduced, if both of the first threshold values $S1_{kat}$, $S1_{par}$ have been exceeded, provided that the degree of sulfation does not lie above a second threshold value $S2_{kat}$ or the charge value above a second threshold value $S2_{par}$.

The patent application mentioned above refers to the triggering of the desulfurization, if certain threshold values are exceeded for the sulfur in the particle filter, respectively in the $NO_x$ storage catalytic converter, and for the particle loading, respectively the sulfur absorption. In fact, it is also cited in this text that initially the regeneration of the particle filter is implemented; and thereafter if need be, the temperature is raised to a minimum temperature and subsequently the work mode of the diesel internal combustion engine is regulated in a closed-loop to $\lambda \leqq 1$. A strategy for the targeted complete combination of both procedures is, however, not indicated in the State of the Art.

For this reason, it is the task of the invention to provide a procedure for the regeneration of a particle filter and for the desulfurization of a $NO_x$ storage catalytic converter. This procedure is optimized with regard to the reduction of the additional fuel consumption and with regard to a high efficiency for the desulfurization of the $NO_x$ storage catalytic converter.

The task of the invention is thereby solved, in that a combined, complete or partial regeneration of the particle filter as well as a desulfurization of the $NO_x$ storage catalytic converter is triggered when a desulfurization for the $NO_x$ storage catalytic converter is requested. In so doing, in contrast to the State of the Art, the regeneration of the particle filter can also be selectively implemented during the desulfating, whereby in cases with a high particle loading if need be, a short lead time for the particle filter regeneration can be required. By means of this coupling, the required heat energy and the fuel consumption associated with it can be significantly reduced. Furthermore, an increase in efficiency of the $NO_x$ storage catalytic converter occurs because the average sulfur absorption is reduced by the greater frequency of the desulfurization phases, whereby the $NO_x$ emissions after the $NO_x$ storage catalytic converter can be further reduced.

If initially starting from the normal operation in a mode of operation "DPF-heating", the particle filter is heated to the temperature required for regeneration and maintained at this temperature by a temperature regulator, the advantage results, in that an optimal temperature can be maintained for the burnout of sooty particles. For the closed-loop control of the temperature, provision can be made for the deployment of a temperature sensor in the area of the particle filter.

A preferred procedural variation makes provision during the mode of operation "DPF-heating" to switch to the operational mode "$NO_x$ storage cat heating" and to specify a new set point temperature. In so doing, an optimal temperature for the desulfurization, which is generally higher than the optimal temperature for the burnout of sooty particles, can be set.

In order to avoid temperature spikes, which can have adverse effects on the longevity of the particle filter, provision can be made for the conditions for the new set point temperature to be tested before switching to the mode of operation "$NO_x$ storage cat heating". In this manner, conditions, for example, like "sooty particle mass threshold value has been undershot" and/or "weakening of the exothermic reaction across the particle filter", can also be evaluated. In so doing, an adaptive regeneration system for the particle filter can be implemented.

If a Lambda value of $\lambda>1$ is set in the exhaust gas during the mode of operation "$NO_x$ storage cat heating", an additional burnout of sooty particles can be observed during this phase.

Provision is made in a preferred procedural variation for the mode of operation to change between "$NO_x$ storage cat heating" and "$NO_x$ storage cat desulfurization" after the new set point temperature has been reached. During this desulfurization phase a significant expulsion of the sulfur from the $NO_x$ storage catalytic converter by means of the short enrichment of the exhaust gas ($\lambda<1$) can on the one hand be observed. In fact, an enrichment of the exhaust gas during this phase is also mentioned in the previously cited State of the Art; however, this occurs only as a function of the charge value and the exhaust gas temperature downstream from the particle filter. During the phases with $\lambda>1$, an additional burn-out of sooty particles is registered at this temperature level. Additionally it is advantageous in the case of this mixing operation within the desulfating phase that an $H_2S$ build-up can be avoided by way of the relatively short phases with $\lambda<1$. In the interruption phases with $\lambda>1$, it is necessary again to fill the $NO_x$ storage catalytic converter with oxygen to avoid an $H_2S$ build-up and if need be to again adjust the optimal process temperature.

In the process it has turned out to be advantageous for the change between the mode of operation "$NO_x$ storage cat heating" and "$NO_x$ storage cat desulfurization" to be specified alternately for certain time intervals, which, for example can depend upon the operational point of the internal combustion engine or the conditions in the $NO_x$ storage catalytic converter.

If the time period for the desulfurization is firmly established and terminated after this time has run out, a complete desulfating can be achieved independently of the period of deployment for the $NO_x$ storage catalytic converter and the operational conditions of the internal combustion engine, provided a sufficiently long period of time for the desulfurization exists. It can be advantageous to continue the desulfurization process for a certain time period after the particle filter regeneration has been completed. This time period is dependent on the degree of sulfation.

It can also be advantageous to end the desulfurization phase in the case of the particle filter being totally or partially regenerated and the degree of effective desulfurization abating as a sign that the desulfurization has been (almost) successfully completed. In so doing, excessive fuel consumption can be avoided.

A similar advantage results if the desulfurization phase is terminated in the case of a completely or partially regenerated particle filter and a simultaneous undershooting of a firmly established threshold value for the sulfur content in the $NO_x$ storage catalytic converter.

It can also be advantageous if the desulfurization phase is terminated, when the particle filter is completely or partially regenerated and simultaneously a firmly established accumulated time period is achieved for the desulfurization. As the accumulated time period for the desulfurization is a measurement for the summary desulfurization capacity and therewith by means of the knowledge of the sulfur being embedded during the normal operation, unnecessarily long desulfurization phases can be avoided.

Provision is made in a procedural variation for the conditions to conclude the desulfurization phase to be combined. As a result an adaptive procedure can also be implemented for the desulfurization, which orientates itself on the actual sulfur content in the $NO_x$ storage catalytic converter and on the operating state of the internal combustion engine.

If the desulfurization phase is terminated and the operation mode "DPF-heating" is continued, when a firmly established threshold value is undershot for the sulfur content in the $NO_x$ storage catalytic converter and when a regeneration of the particle filter is still not fully completed, the advantage occurs during this combined procedure, in that the regeneration of the particle filter as well as the desulfating of the $NO_x$ storage catalytic converter can in each case be optimally implemented.

BRIEF DESCRIPTION OF THE DRAWINGS

The invention is explained in detail below using the examples of embodiment depicted in the figures. The following are shown:

FIG. 1 shows a technical layout as an example, in which the procedure according to the invention is operating. In the figure, an internal combustion engine 1, consisting of an engine block 40 and an incoming air duct 10, which provides the engine block 40 with combustion air, is depicted, whereby the amount of air in the incoming air duct 10 can be determined using an incoming air measurement device 20. The exhaust gas of the internal combustion engine 1 is carried in the depiction by way of an emission control system, which has an exhaust gas duct 50 as its main component. A particle filter 70 (DPF) and subsequently a $NO_x$ storage catalytic converter 90 are disposed in the exhaust gas duct 50 in the direction of flow. Provision is additionally made on the engine block 40 for a fuel metering mechanism 30 in the form of a diesel injection system, which is controlled in a closed-loop, respectively actuated, by way of an engine control unit 110. In similar technical layouts, the $NO_x$ storage catalytic converter 90 (NSC) can also be disposed in front of the particle filter 70 (DPF). Furthermore, combinations with an OSC (Oxygen Storage Catalyst), NSC and with a DPF are conceivable. Any mixtures with multiple components of the same type (for example: NSC1, DPF, NSC2, . . . ) are likewise possible.

Figure 1:
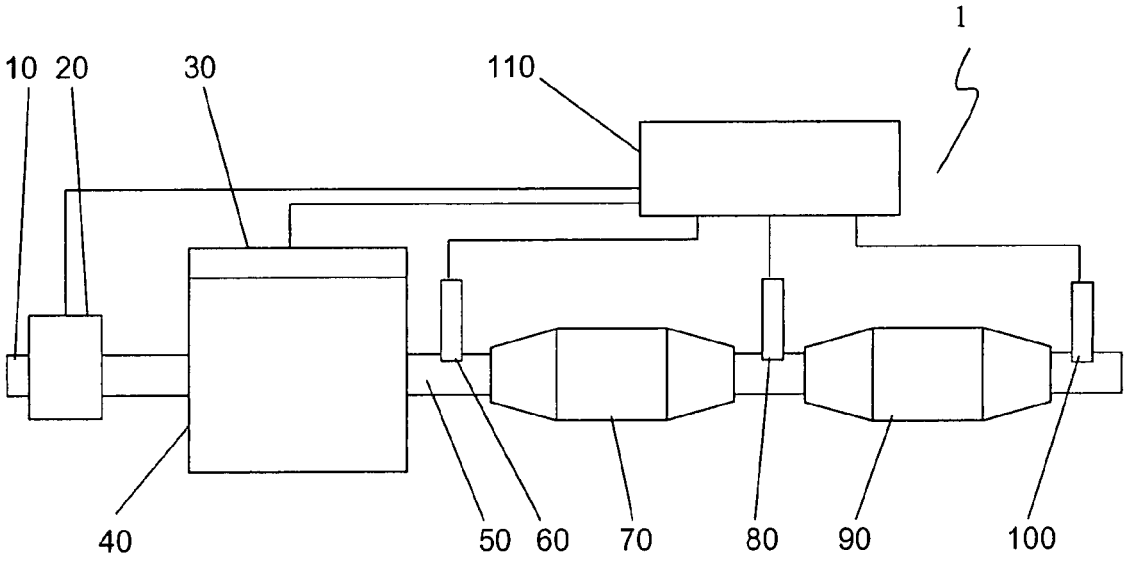
FIG. 1 a schematic depiction of an internal combustion engine with an exhaust gas aftertreatment system as an example of application of the procedure, FIG. 2 the chronological temperature progression in a particle filter and in a $NO_x$ storage catalytic converter, FIG. 3 the chronological progression for various modes of operation, FIG. 4 the chronological progression of a mass of sooty particles in the particle filter and FIG. 5 the chronological progression of a mass of sulfur in the $NO_x$ storage catalytic converter.

The closed-loop control of a work mode of the internal combustion engine 1 can result using selected operating parameters. It is therefore conceivable to determine a composition of the exhaust gas by means of Lambda probes 60 and/or $NO_x$ sensors 100 disposed in the exhaust gas duct 50. An exhaust gas temperature can, for example, be additionally determined in the area of the emission control system, for example between the particle filter 70 and the $NO_x$ storage catalytic converter 90 by means of one or several temperature probes 80. From the signals of the different probes 60, 80, 100, which are connected to the engine control unit 110, as well as from the data of the incoming air measurement device 20, the mixture can be calculated and the fuel metering mechanism 30 can be correspondingly actuated to meter the fuel.

Provision is made in the procedure according to the invention for the regeneration of the particle filter 70 as well as the desulfurization of the $NO_x$ storage catalytic converter 90, in that in the case of a regeneration request for the particle filter 70 or a desulfurization request for the $NO_x$ storage catalytic converter 90, a combined regeneration of the particle filter 70 as well as the $NO_x$ storage catalytic converter 90 is initiated. A desulfurization request can, for example, be initiated in the case of an improper fueling or in the case of the diesel fuel containing a high content of sulfur.

Initially the particle filter 70 starting from the normal operation 141 in a mode of operation "DPF-heating" 142 is heated up to the temperature (for example 550 to 650° C.) required for regeneration, and it is maintained at this temperature by a temperature regulator. After a threshold for sooty particles has been undershot during the DPF-regeneration (regeneration of the particle filter 70), the operation is switched to the mode of operation "$NO_x$ storage cat heating" 143; and a new set point temperature (for example 600 to 750° C.) is specified, whereby in order to avoid temperature spikes before switching to the mode of operation "$NO_x$ storage cat heating" 143, conditions for this new set point temperature are tested. During the mode of operation "$NO_x$ storage cat heating" 143, a Lambda value of $\lambda>1$ is set in the exhaust gas. If sooty particles are still present in the particle filter 70, burnout is consequently also continued during this phase.

After the new set point temperature has been achieved, changeover occurs between the mode of operation "$NO_x$ storage cat heating" 143 and the mode of operation "$NO_x$ storage cat desulfurize" 144, whereby the changeover alternating between the mode of operation "$NO_x$ storage cat heating" 143 and the mode of operation "$NO_x$ storage cat desulfurize" 144 is specified (typically for, for example, 10 s at a time).

The conditions for a completion of the desulfurization can be different according to the subsequent list, whereby these can also be deployed in combination. The desulfurization can be terminated, if

- a firmly established time period for the desulfurization is achieved and/or
- the degree of efficiency of the desulfurization decreases after the particle filter 70 has been regenerated and/or
- a firmly established threshold value for the sulfur content in the $NO_x$ storage catalytic converter 90 is undershot after the particle filter 70 has been regenerated and/or
- a firmly established accumulated time period for the desulfurization is exceeded after the particle filter 70 has been regenerated.

Provision is furthermore made in the procedure according to the invention for the desulfurization phase to be terminated and the "DPF-heating" 142 to be continued when a firmly established threshold value for the sulfur content in the $NO_x$ storage catalytic converter 90 has been undershot, and the regeneration of the particle filter 70 has not been completely concluded.

Figure 2:
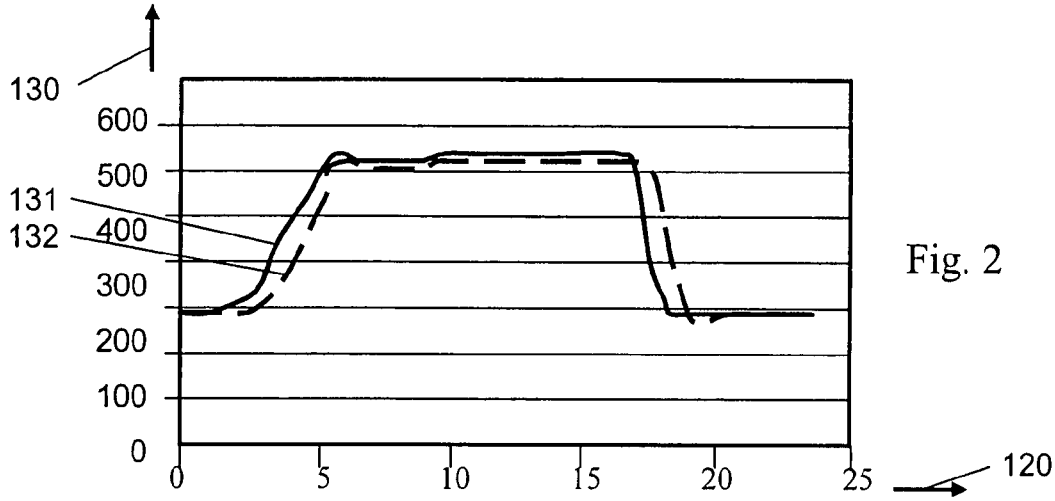

FIG. 2 shows as an example the progression for the temperatures (° C.) in the $NO_x$ storage catalytic converter 90 (NSC-temperature 131) and in the particle filter 70 (DPF-temperature 132) as a function of time 120 (minutes).

Figure 3:
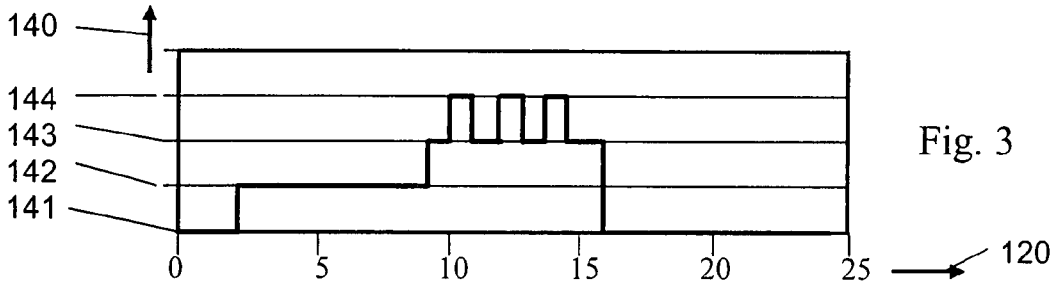

In FIG. 3 the various modes of operation 140 are plotted in their chronological sequence, as previously described.

Figure 4:
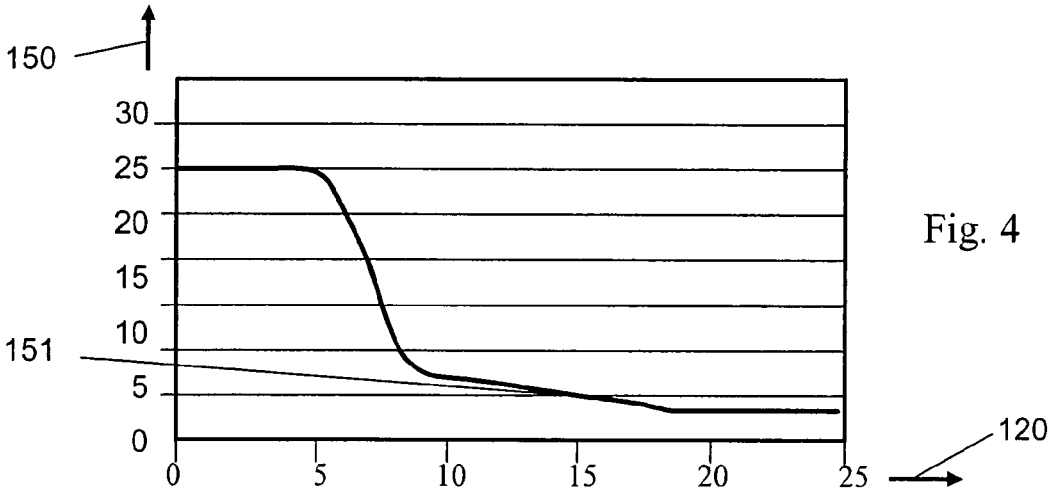
Figure 5:
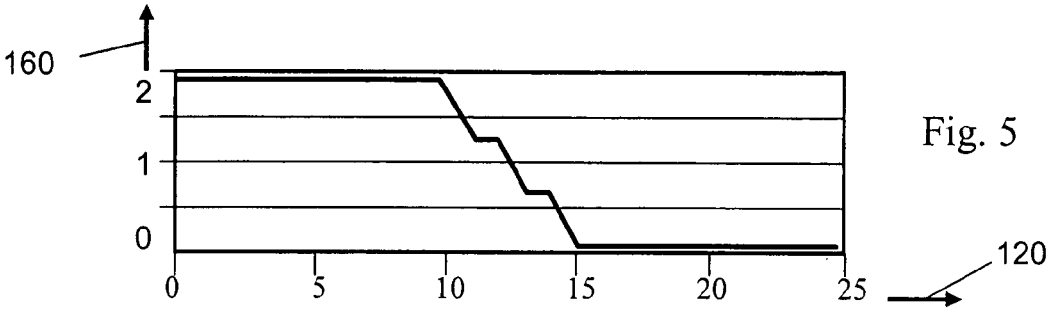

FIG. 4 and FIG. 5 show the progression of the mass of sooty particles 150 (g) in the particle filter 70 as well as that of a mass of sulfur 160 (g) in the $NO_x$ storage catalytic converter 90 as a function of time 120 (minutes).

As can be recognized in FIG. 2, the temperature in the particle filter 70 and in the $NO_x$ storage catalytic converter 90 initially rise above 500° C. on account of the changeover to the mode of operation "DPF-heating" 142. After achieving this optimal temperature for the burnout of the sooty particles, the burnout of the sooty particles begins, which makes itself known by the reduction of the mass of sooty particles 150 in FIG. 4. A status "Particle filter empty" 151 is achieved, if the mass of sooty particles 150 has achieved a certain threshold value (here for example 5 g). Already before this point in time, the operation has been switched over to the mode of operation "$NO_x$ storage cat heating" 143. During this mode of operation, an additional burnout of sooty particles is registered. Only with the repeatedly occurring changeover to the mode of operation "$NO_x$ storage cat desulfurize" 144, a significant decrease in the mass of sulfur 160 occurs in the $NO_x$ storage catalytic converter 90.

With the indicated procedure the necessary heating energy and with it the associated fuel consumption can be significantly reduced. Furthermore, an increase in efficiency of the $NO_x$ storage catalytic converter 90 results, because the average sulfur absorption is reduced by the greater frequency of the desulfurization phases, whereby the $NO_x$ emissions after the $NO_x$ storage catalytic converter 90 can further be reduced.

The invention claimed is:

1. A method of regenerating a particle filter and for the desulfurization of a $NO_x$ storage catalytic converter in an exhaust gas aftertreatment system of an internal combustion engine, the method comprising:

raising a temperature of the particle filter in at least one mode of operation "DPF-heating"; heating up the $NO_x$ storage catalytic converter in at least a second mode of operation "$NO_x$ storage cat heating";

in a subsequent mode of operation, setting a Lambda value of $\lambda<1$ in an exhaust gas; and when a regeneration is requested for the particle filter or a desulfurization is requested for the $NO_x$ storage catalytic converter initializing a combined complete or partial regeneration of the particle filter as well as a desulfurization of the $NO_x$ storage catalytic converter;

wherein after or during the mode of operation "DPF-heating", switching the operation to the second mode of operation "$NO_x$ storage cat heating", specifying a new set point temperature, and wherein during mode of operation "$NO_x$ storage cat heating", setting a Lambda value of $\lambda>1$ in the exhaust gas.

2. A method according to claim 1, further comprising in the mode of operation "DPF-heating", heating up the particle filter to a temperature required for regeneration and maintaining this temperature using a temperature regulator.

3. A method according to claim 1, wherein the time period of the desulfurization is firmly established and is terminated after the expiration of this time.

4. A method according to claim 1, wherein the desulfurization phase is terminated when the particle filter is completely or partially regenerated and when a degree of efficiency of the desulfurization decreases.

5. A method according to claim 1, wherein the desulfurization phase is terminated, when the particle filter is completely or partially regenerated and when a firmly established threshold value for a sulfur content in the $NO_x$ storage catalytic converter is undershot.

6. A method according to claim 1, wherein the desulfurization phase is terminated, when the particle filter is completely or partially regenerated and when a firmly established accumulated time period for the desulfurization is achieved.

7. A method according to claim 1, wherein after achievement of the new set point temperature, making an operational changeover between the mode of operation "$NO_x$ storage cat heating" and a mode of operation "$NO_x$ storage cat desulfurize".

8. A method according to claim 7, wherein the changeover between the mode of operation "$NO_x$ storage cat heating" and the mode of operation "$NO_x$ storage cat desulfurize" is specified alternately for certain time intervals.

9. A method according to claim 1, wherein the desulfurization phase is terminated based on at least one of a first condition, a second condition, a third condition and a fourth condition:

a. the first condition being an achievement of a firmly established time period for the desulfurization phase;

b. the second condition being a sufficient decrease in the degree of efficiency of the desulfurization phase after the particle filter has been regenerated;

c. the third condition being an undershooting of a firmly established threshold value for sulfur content in the $NO_x$ storage catalytic converter after the particle filter has been regenerated; and d. the fourth condition being an exceeding of a firmly established accumulated time period for the desulfurization phase after the particle filter has been regenerated.

10. A method according to claim 9, wherein the desulfurization phase is terminated based on the combination of at least two of the first condition, the second condition, the third condition and the fourth condition.

11. A method of regenerating a particle filter and for the desulfurization of a $NO_x$ storage catalytic converter in an exhaust gas aftertreatment system of an internal combustion engine, the method comprising:

raising a temperature of the particle filter in at least one mode of operation "DPF-heating";

heating up the $NO_x$ storage catalytic converter in at least a second mode of operation "$NO_x$ storage cat heating";

in a subsequent mode of operation, setting a Lambda value of $\lambda<1$ in an exhaust gas; and when a regeneration is requested for the particle filter or a desulfurization is requested for the $NO_x$ storage catalytic converter initializing a combined complete or partial regeneration of the particle filter as well as a desulfurization of the $NO_x$ storage catalytic converter;

wherein after or during the mode of operation "DPF-heating", switching the operation to the second mode of operation "$NO_x$ storage cat heating", specifying a new set point temperature; and wherein conditions for specifying a new set point temperature are tested before switching to the mode of operation "$NO_x$ storage cat heating."

12. A method of regenerating a particle filter and for the desulfurization of a $NO_x$ storage catalytic converter in an exhaust gas aftertreatment system of an internal combustion engine, the method comprising:

raising a temperature of the particle filter in at least one mode of operation "DPF-heating";

heating up the $NO_x$ storage catalytic is converter in at least a second mode of operation "$NO_x$ storage cat heating";

in a subsequent mode of operation, setting a Lambda value of $\lambda<1$ in an exhaust gas; and when a regeneration is requested for the particle filter or a desulfurization is requested for the $NO_x$ storage catalytic converter initializing a combined complete or partial regeneration of the particle filter as well as a desulfurization of the $NO_x$ storage catalytic converter;

wherein the desulfurization phase is terminated and the mode of operation "DPF-heating" is continued, when a firmly established threshold value for the sulfur content in the $NO_x$ storage catalytic converter is undershot and when the regeneration of the particle filter is still not completely concluded.

* * * * *